US006343870B1

(12) United States Patent
Chang

(10) Patent No.: US 6,343,870 B1
(45) Date of Patent: Feb. 5, 2002

(54) FIGURED LAMP STRUCTURE

(76) Inventor: Ching Hsi Chang, No. 24-2, Ta E Li, Chupei, Hsinchu (TW)

( * ) Notice: Subject to any disclaimer, the term of this patent is extended or adjusted under 35 U.S.C. 154(b) by 0 days.

(21) Appl. No.: 09/694,327

(22) Filed: Oct. 24, 2000

(51) Int. Cl.[7] ..... F21S 4/00

(52) U.S. Cl. ..... 362/227; 362/226; 362/236; 362/391; 362/806; 439/619

(58) Field of Search ..... 362/252, 227, 362/238, 807, 806, 391, 226, 236; 439/619

(56) References Cited

U.S. PATENT DOCUMENTS 5,150,964 A * 9/1992 Tsui ..... 362/251

6,238,062 B1 * 5/2001 Hsu ..... 362/267

* cited by examiner

*Primary Examiner*—Sandra O'Shea
*Assistant Examiner*—John Anthony Ward
(74) *Attorney, Agent, or Firm*—Rosenberg, Klein & Lee

(57) ABSTRACT

The present invention relates to a figured lamp structure with a specially designed connection mechanism. It mainly comprises a simple coupling element in conjunction with connection mechanisms disposed on the ends of a lamp case to enable the figured lamp to be connected to another one in series in an easy way. By such a mechanism, a plurality of lamps can be put together to form a lamp array to arrive at a unique decorative effect.

2 Claims, 4 Drawing Sheets

FIGURED LAMP STRUCTURE

BACKGROUND OF THE INVENTION

Most of decorative lamps acquire attraction directly by illumination. Others give visual effects through lighting in association with ornamental frames or cases, which are made of transparent, translucent or opaque material adorned with sculptured or molded features, figures or patterns. These frames or cases enclose a light bulb therein. Through the light bulb giving out light, they attract people's interest by a combination of lighting and frame or case shapes. However, conventional design does not provide connection means and thus can only fit for separate decorative lamps. It is not suitable for a lamp array composed of a plurality of decorative lamps.

In view of the above problems, the primary object of the invention is to provide a figured lamp structure that is provided with innovative connection means by which a plurality of figured lamps can be connected in series to form a lamp array and achieve an unique visual effect. Now the features and structure of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
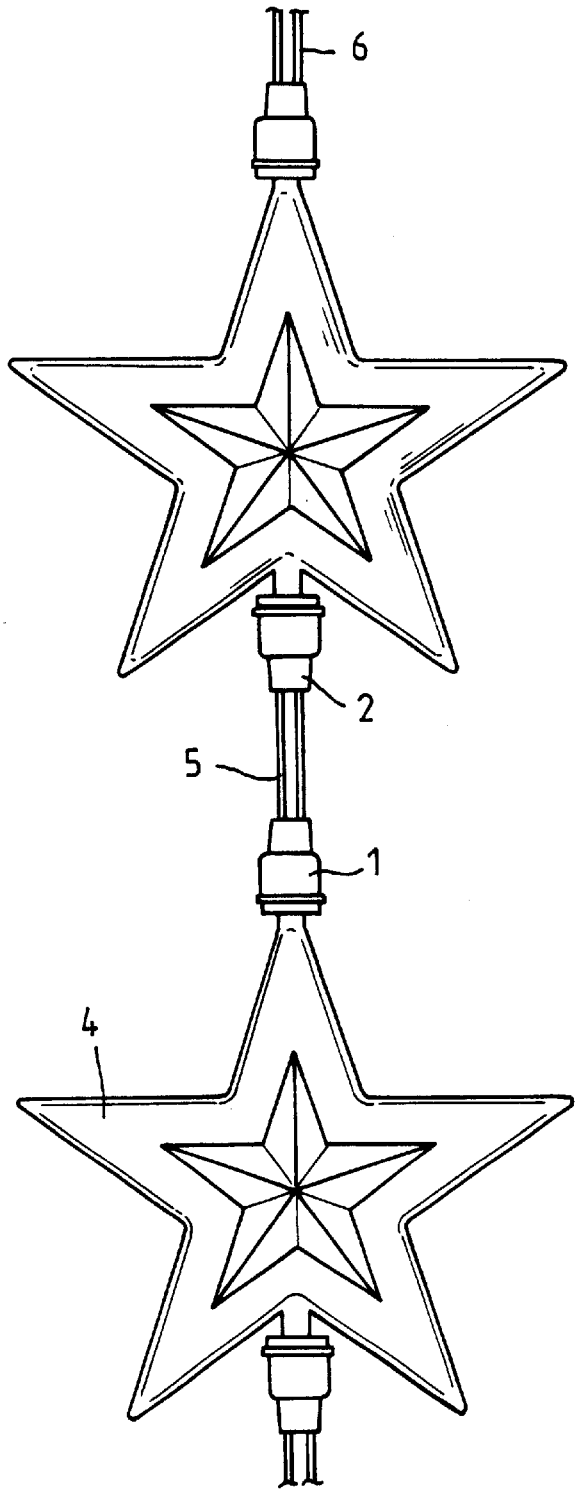
FIG. 1 is a plan view showing an embodiment of the figured lamp structure according to the invention.
Figure 2:
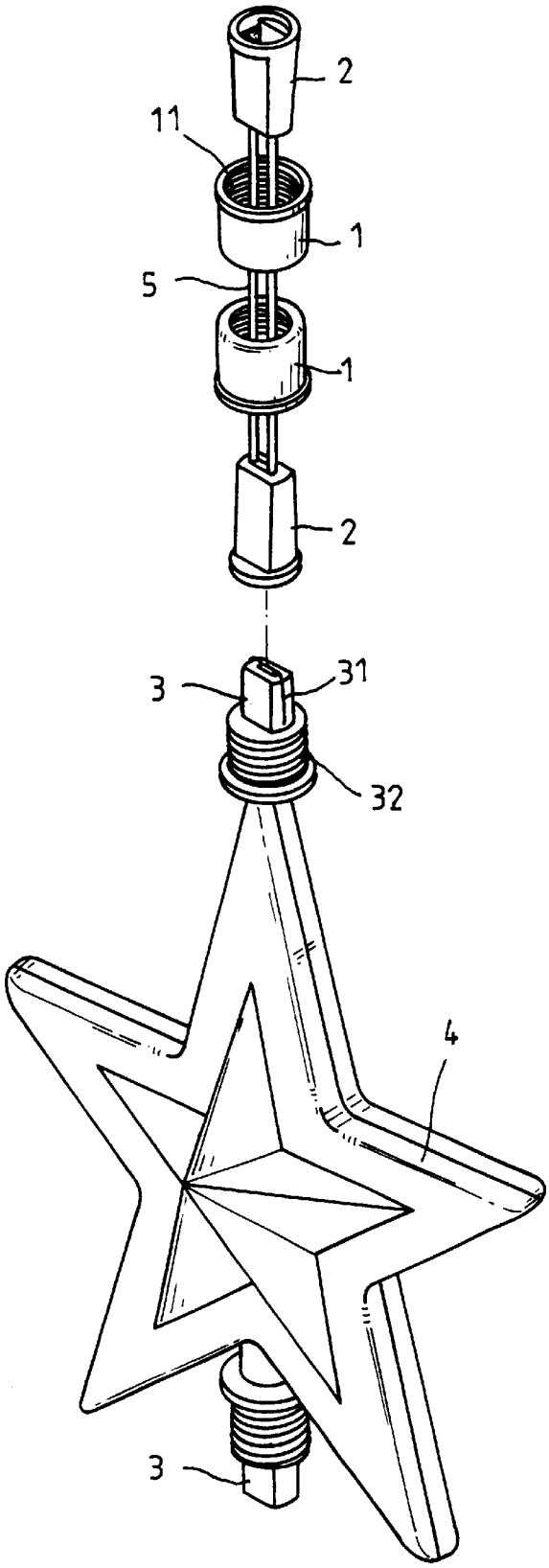
FIG. 2 is an exploded view showing the constituents of the figured lamp structure of FIG. 1.
Figure 3:
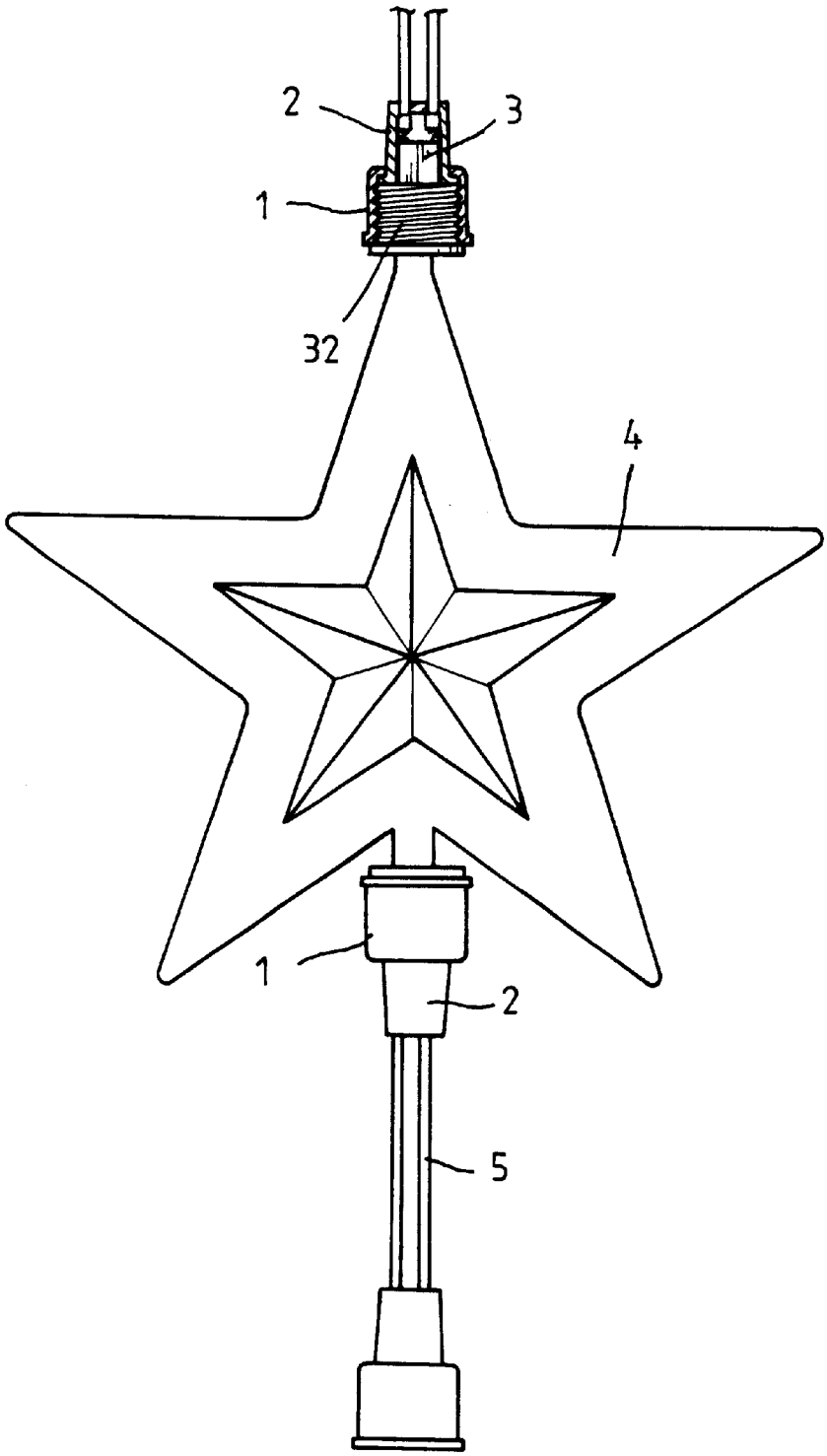
FIG. 3 is a partial cross sectional view of the figured lamp structure of FIG. 1.

As shown in the accompanying drawings, a lamp structure according to the present invention comprises a figured lamp case (4) that can be of arbitrary shapes. The case (4) is provided on two opposite ends with male connection means (3) and houses a light bulb therein. The conductive wires (31) of the light bulb extend from the inside of the case (4) through the central opening of the male connection means (3) to the outside and bend toward two sides respectively. The present invention further comprises a coupling element that consists of electrical conductive wires (5) two ends of which are individually provided with a female connection means (2) and a sleeve (1). The female connection means (2) is designed to snugly mate with the male connection means (3). When the female connection means (2) is mounted on the male connection means (3). the conductive wires (31) of the light bulb are in positive contact with the electrical conductive wires (5) of the coupling element. The sleeve (1) locks the female connection means (2) in position by an engagement of the internal screw threads (11) on the inner wall surface thereof with the outer screw threads (32) on the outer wall surface of the male connection means (3). Effective coupling between the sleeve (1) and the male connection means (3) is possible in other various manners.

Figure 4:
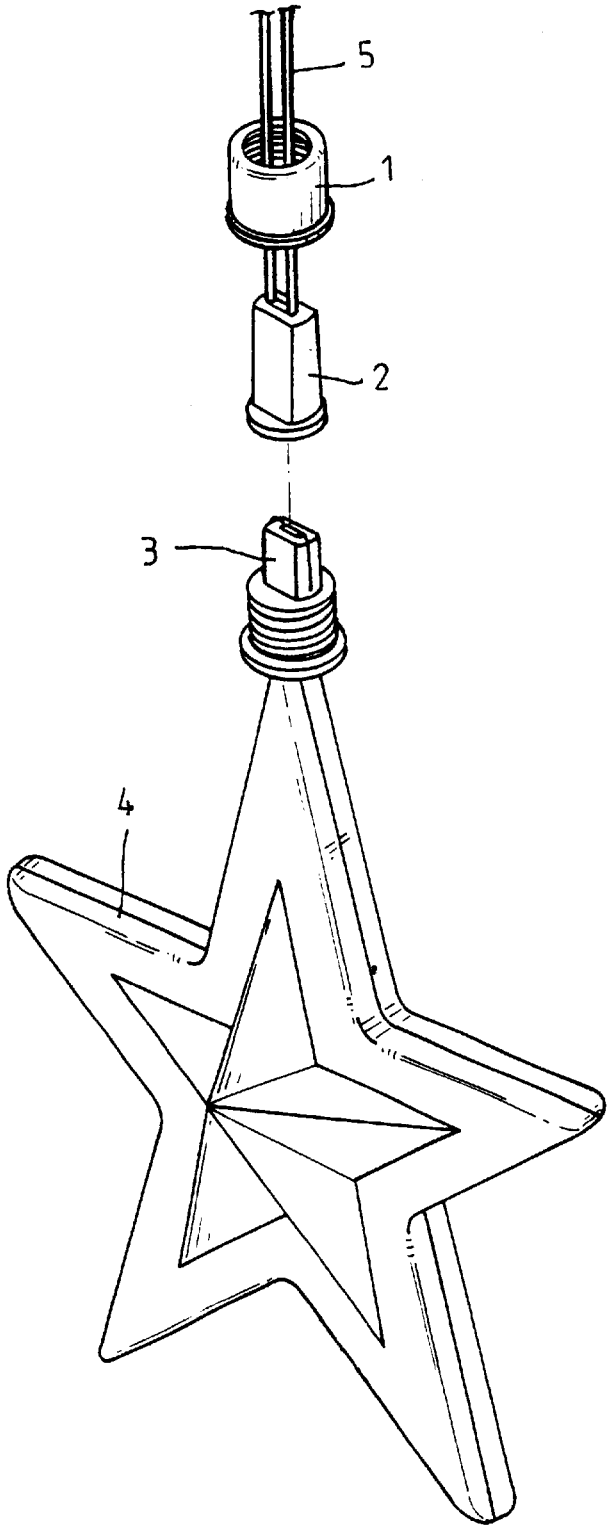
FIG. 4 illustrates the structure of a lamp at the end of a lamp array according to the invention.

From the described above, the invention utilizes a coupling element to enable two or more figured lamps to be electrically and physically connected in series in a simple and quick way to form a lamp array. When the first lamp is attached to a power source by electrical conductive wires, all the lamps in the lamp array are lit on. Thus the present invention can achieve an unparalleled visual effect that has never found in a conventional figured lamp. FIG. 4 shows a lamp structure that is used for the one on the ends of a lamp string or array according to the invention. The lamp on the ends is provided with only one male connection means. It is understood that the invention is not limited to the exemplary embodiment described above, but that various modifications are possible within the scope of the invention. For instance, the lamp shape can be of any desirable form and the lamp structure can be provided with two or more connection means. In the embodiment described above, it is evident that the lamp case can be equipped with up to five connection means. In such a case, it is possible to have a planar lamp array.

In brief, the present invention has the essence of a patent. We hereby apply for a patent grant.

What is claimed is:

1. A figured lamp structure comprising a lamp string that consists of lamps connected in series, each lamp having a case that is provided on two ends thereof with male connection means, through the central opening of which the electrical conductive wires of the light bulb housed in the case extend to the outside and then bend to two sides, a coupling element consisting of conductive wires with a female connection means and a sleeve on both ends; said female connection means being designed to snugly fit for said male connection means so that when said female connection means is mounted on said male connection means the conductive wires of the light bulb are in positive, contact with the electrical conductive wires of the coupling element and said sleeve locking said female connection means in position by a screw thread engagement with said male connection means; and characterized in that each lamp with such a structure can be quickly connected in series to another one through said connection means and all lamps connected in such a manner can be lit on by attaching the first one to a power source to achieve a lighting effect.

2. The figured lamp structure as claimed in claim 1, wherein said lamp case can be of any desired shape and can be provided with two or more connection means, in that case a plurality of lamps can be joined to form a planar lamp array with enhanced visual effects.

* * * * *